US007063210B2

(12) United States Patent
Smyers et al.

(10) Patent No.: US 7,063,210 B2
(45) Date of Patent: Jun. 20, 2006

(54) STACKABLE CRATE

(75) Inventors: Justin M. Smyers, Redondo Beach, CA (US); Trenton M. Overholt, Manhattan Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 686 days.

(21) Appl. No.: 09/921,762

(22) Filed: Aug. 3, 2001

(65) Prior Publication Data

US 2003/0024845 A1 Feb. 6, 2003

(51) Int. Cl.
*B65D 21/032* (2006.01)

(52) U.S. Cl. ..... 206/509

(58) Field of Classification Search ..... 206/509
See application file for complete search history.

(56) References Cited

U.S. PATENT DOCUMENTS 4,848,580 A * 7/1989 Wise ..... 206/508
4,932,532 A * 6/1990 Apps
5,439,113 A * 8/1995 Elvin-Jensen ..... 206/509
5,445,273 A * 8/1995 Apps ..... 206/505

FOREIGN PATENT DOCUMENTS

| | | |
|---|---|---|
| DE | 1 181 119 | 11/1964 |
| DE | 199 16 730 | 10/2000 |
| FR | 1 320 916 | 3/1963 |
| GB | 964930 | 7/1964 |

* cited by examiner

*Primary Examiner*—Stephen Castellano

(57) ABSTRACT

A crate is provided for holding and transporting products such as plastic milk containers. In accordance with one aspect, a tighter lateral tolerance or fit is provided to stabilize and strengthen telescopic stacking of crates by contouring an inner surface of the side walls to provide a smaller dimension in the opening of the crate, such as by selectively removing or reducing any outward taper or draft of the side walls. In accordance with another aspect, loading forces are directly transferred to a bottom drag rail by forming the side walls to position at least a portion of the side wall inner surface over the drag rail.

38 Claims, 4 Drawing Sheets

STACKABLE CRATE

BACKGROUND OF THE INVENTION

1. Field of the Invention

The present invention relates to a stackable, open-top crate for holding and transporting objects.

2. Background Art

Generally, crates for carrying objects such as milk containers are molded from plastic to form an open-top box having four side walls integrated with a bottom surface. A partial cross section representative of a conventional crate is shown in FIG. 1. As shown, a side wall 10 is integrally formed with a bottom surface 12. An underside portion 14 of the bottom surface is typically formed with a drag rail 16 around the periphery of the underside portion. The drag rail functions to raise the bottom of the crate off a floor surface, as well as to provide a positioning and holding feature when stacked arranged to nest within the top of another crate to facilitate stacking thereof. The latter function is performed by positioning the drag rail of one crate so as to fit within the inner upper edge of another crate, thus positioning the crate directly above for maximum stability. When stacked with another crate, the drag rail provides alignment and stability of the stacked formation.

In addition, crates have been molded or formed so that the interior side walls possess a taper or draft (denoted by an outwardly curved or angled inner surface 18 in FIG. 1) to maximize the dimension of the upper inner edge surface of the crate and improve manufactureability. In other words, the side walls are formed so that the internal width dimension at the upper inner edge surface of the crate is increased relative to the internal width at the bottom surface. Increasing the dimension of the upper inner edge of the crate eases loading and unloading of products to and from the crate.

However, such increased dimensioning of the upper edge also increases the clearance between the outside of the drag rail of a stacked crate and the upper edge and retaining face of the lower crate. As a consequence, the lateral tolerance between stacked crates is too great, thereby potentially compromising the stability and alignment of a stack of crates.

In addition, the drag rail of known crate designs is spaced away from the outer edge of the crate to facilitate nesting within another crate when stacked thereon. This spacing is denoted by reference number 20 in FIG. 1. Because of the spaced relationship, any vertical load forces F placed on the side walls can not be directly transferred down to the floor surface because the drag rail is not positioned in vertical alignment with the side walls. Instead, the drag rail operates as a fulcrum. This undesirably results in added stresses in the bottom area "fulcrum" due to its inability to resist top load compression. The added stresses result in deflection and potential unbalancing of a stacked formation.

Therefore, a need exists for a crate that cost effectively improves stability and stacking fit while still providing an enlarged opening for ease of product loading and unloading.

SUMMARY OF THE INVENTION

In accordance with one aspect of the present invention, a crate and method of making the same are provided so that a portion of an upper surface area of an inner side wall is contoured to provide a tighter tolerance for stacking of another crate thereon.

In accordance with another aspect of the present invention, a crate and method of making the same are provided so that a lower portion of the inner side walls is contoured so as to position at least a portion of the inner surface of a side wall over a drag rail.

In accordance with these and other aspects, the present invention provides a stackable crate including a side wall integrally formed with a bottom surface so that at least a portion of an opening in the crate has a larger dimension than the bottom surface, and a drag rail formed on an underside portion of the bottom surface. A portion of an inner surface of the side wall is formed to reduce the dimension of the crate opening in at least one selected area so as to provide a tighter fit with a drag rail of a crate stacked thereon.

In further accordance with the present invention, a crate is provided including a side wall integrally formed with a bottom surface. A drag rail is formed on an underside portion of the bottom surface, and an inner surface of the side wall is formed to position at least a portion of the side wall over the drag rail.

In accordance with another aspect of the present invention, a method is provided for forming a stackable crate for holding and transporting products including forming a side wall with a bottom surface so that at least a portion of an opening in the crate has a larger dimension than the bottom surface, forming a drag rail on an underside portion of the bottom surface, and contouring the inner surface of the side wall to reduce the dimension of the crate opening in at least one selected area so as to provide a tighter fit with a drag rail when a crate is stacked thereon.

In accordance with still another aspect of the present invention, a method is provided for forming a crate for holding and transporting products including integrally forming a side wall with a bottom surface, forming a drag rail on an underside portion of the bottom surface, and forming an inner corner geometry of the side wall that position at least a portion of the side wall over the drag rail to transfer vertical forces into the top of the drag rail instead of cantilevering the forces on a high-stress fulcrum.

The above aspects and other aspects, features, and advantages of the present invention are readily apparent from the following detailed description of the preferred embodiment (s) when taken in connection with the accompanying drawings.

DETAILED DESCRIPTION OF THE PREFERRED EMBODIMENT(S)

Figure 2:
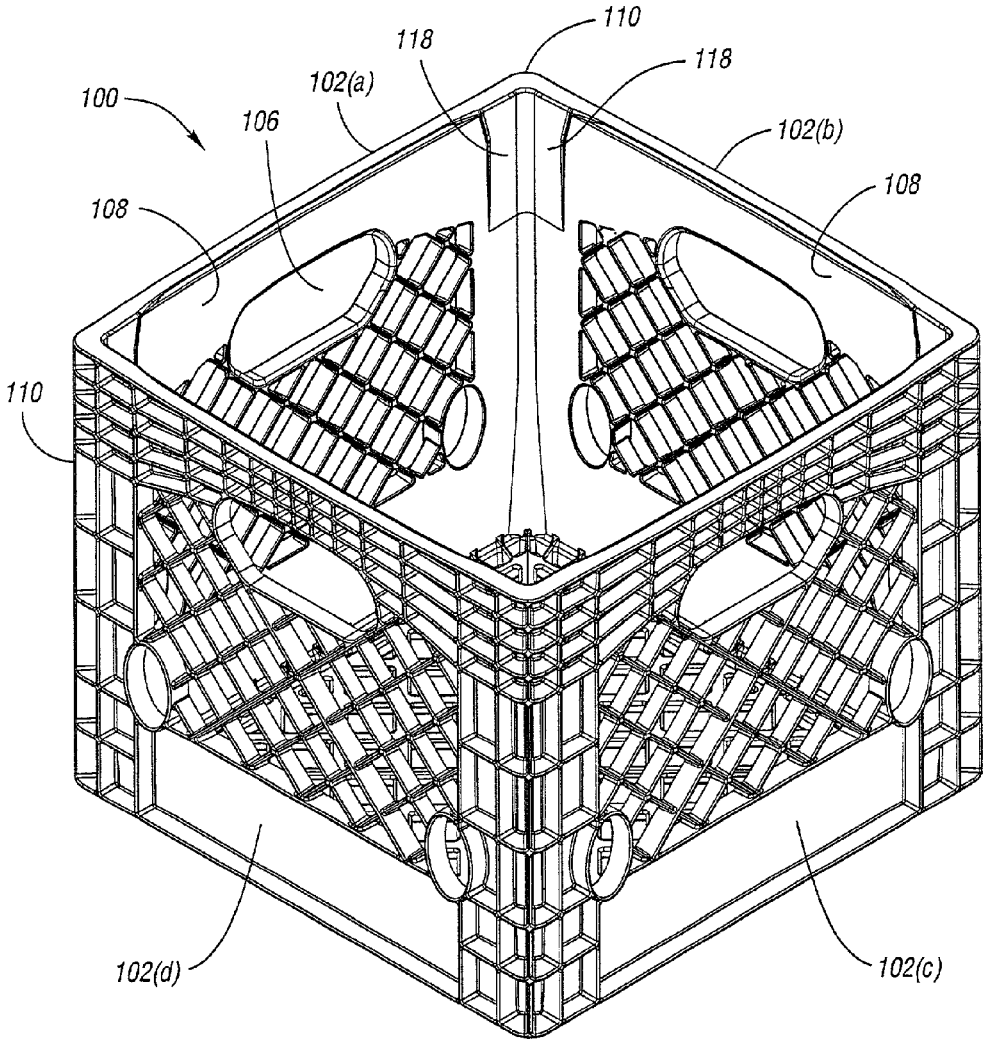
FIG. 2 is an elevated perspective view of a crate in accordance with an exemplary embodiment of the present invention.
Figure 3:
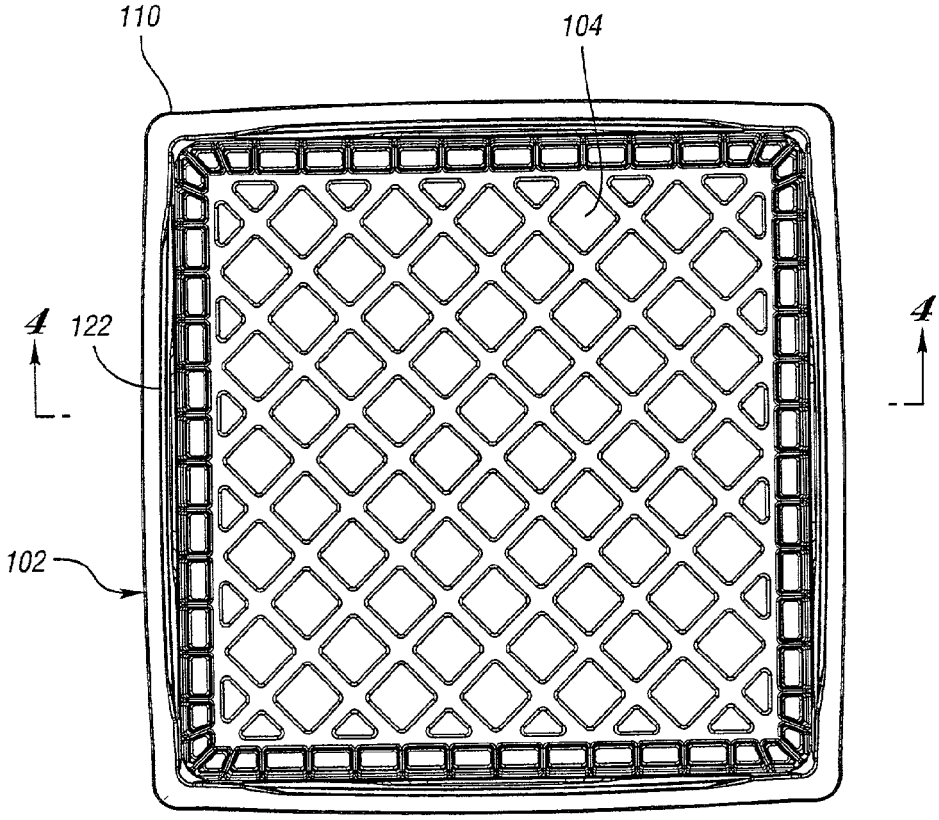
FIG. 3 is top view of the crate of FIG. 2.
Figure 4:
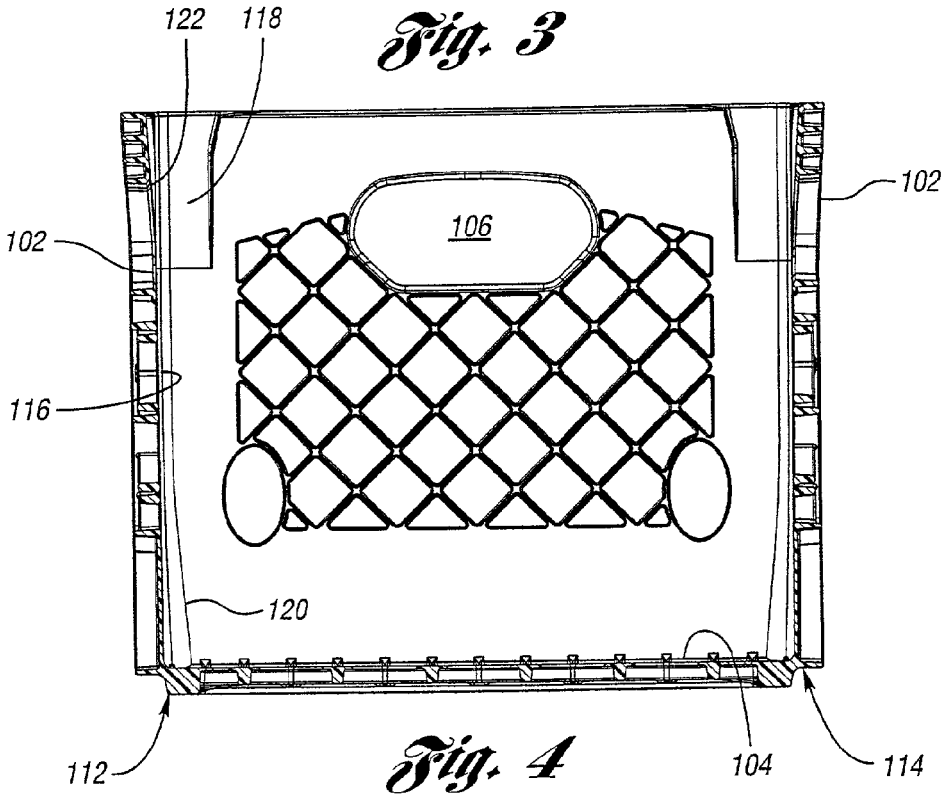
FIG. 4 is a cross-section taken along the line 4—4 in FIG. 3.

Referring to FIGS. 2–4, a stackable crate 100 is shown in accordance with an exemplary embodiment of the present invention. Crate 100 is formed as an enclosure, which can be injection molded from a thermoplastic material so as to integrally form one or more side walls 102 and a bottom surface 104. In the exemplary embodiment, crate 100 includes four side walls 102(*a*)–102(*d*) arranged in an open-top box configuration so as to be generally square shaped and dimensioned to receive a plurality of bottles such as conventional plastic milk containers. However, the present invention, as described more fully below, can be applied to any type and shape of stackable crate for holding containers of various sizes. Thus, the precise configuration shown in the Figures is not to be construed as limiting.

As further shown, each side wall 102 includes a handle or opening 106 formed therein. Each wall 102 can include a middle section 108 having a portion thereof formed as a lattice pattern. Walls 102 also include end sections that are integrally formed with end sections of adjoining side walls to form corners 110. Bottom surface 104 can also include a lattice pattern (as best seen in FIG. 3). As shown in FIG. 4, an underside of bottom surface 104 includes a drag rail 112 integrally formed therewith. As denoted at 114, the drag rail 112 is set back from the outer circumferential edge of the crate so as to be positioned for nesting within the upper opening of another crate. The telescopic stacking of two crates is shown in cross-section in FIG. 6.

As best seen in FIG. 4, an inner surface 116 of each side wall is formed having a taper 122 or draft that maximizes the dimension of the upper inner edge surface of the crate. The taper is typically achieved by suitable shaping of a mold to provide an angled face. The face of the side wall could also be curved. The taper causes the contour of the inner surface to protrude outwardly as the wall extends upwardly, thereby allowing middle sections 108 to form an enlarged opening across the inner dimension of the upper edge surface of the crate. Enlarging the opening of the crate eases loading and unloading of products to and from the crate by providing greater clearance so that a product can be tilted or angled as it is slid in or out of the crate. The elements of crate 100 described so far are well understood to those having ordinary skill in the art.

In accordance with a first aspect of the present invention, the inner surface of a section of each side wall is contoured at or near the upper inner edge of the crate so as to reduce the dimension of the crate opening in at least one selected area to provide a tighter fit with a drag rail of a crate stacked thereon. In the exemplary embodiment, this is provided by contouring an inner surface of at least a portion of a side wall to remove or reduce the taper formed in the remaining portion of the wall. The removed or reduced taper produces a smaller inner diameter crate opening in the affected area, i.e., the corners of the crate in the exemplary embodiment, which in turn produces a tighter lateral tolerance or fit in the upper corners of the crate. In accordance with the present invention, this contouring does not involve adding any extra material or thickness to the inner surface of side walls. Rather, the shape of the inner surface is molded to transition from the taper to the non-tapering portion. The non-tapering portion is illustrated as surface 118 in the partial cross-section representation of FIG. 5. In the exemplary embodiment shown in FIGS. 2–4, the non-tapering contour 118 is formed at the upper edge of each corner. However, the non-tapering portion could also be formed near the middle of each wall. Such a position would allow the non-tapering portion to partially partition the crate into different internal compartments.

Figure 6:
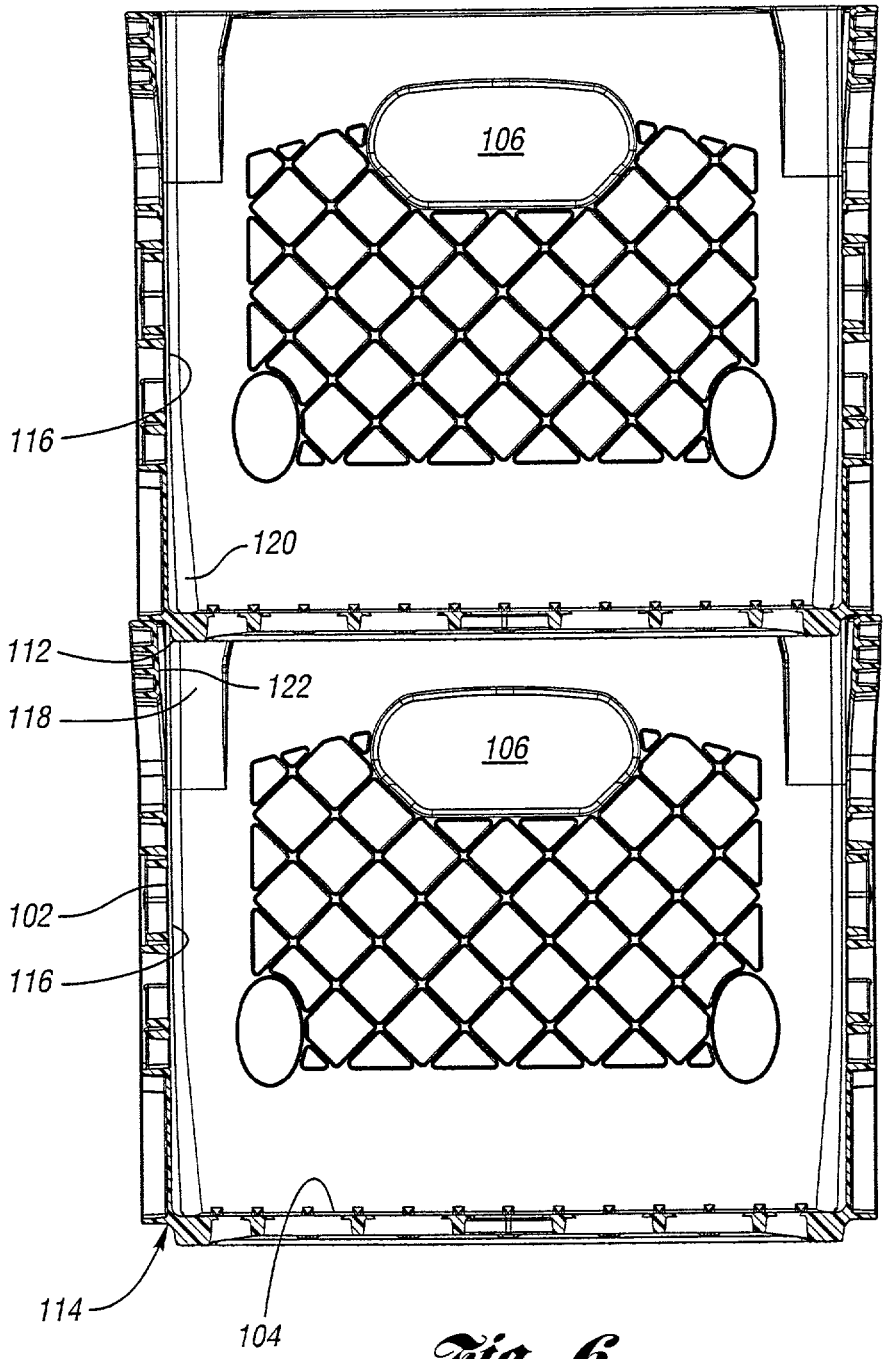
FIG. 6 is a cross-sectional side view of a stacked formation of crates in accordance with the present invention.

As seen in FIG. 6, the non-tapering portion 118 provides a smaller inner dimension to tighten and improve the fit with the drag rail 112 of a crate stacked thereon. In the exemplary embodiment, since non-tapering portion 118 is located only at the corners, the middle sections 108 will still taper outwardly to maximize the inner opening of the crate between opposing middle sections. The surface area of the non-tapering portion 118 is dimensioned to provide a desired amount of contact surface for engagement with a nesting drag rail 112.

Figure 1:
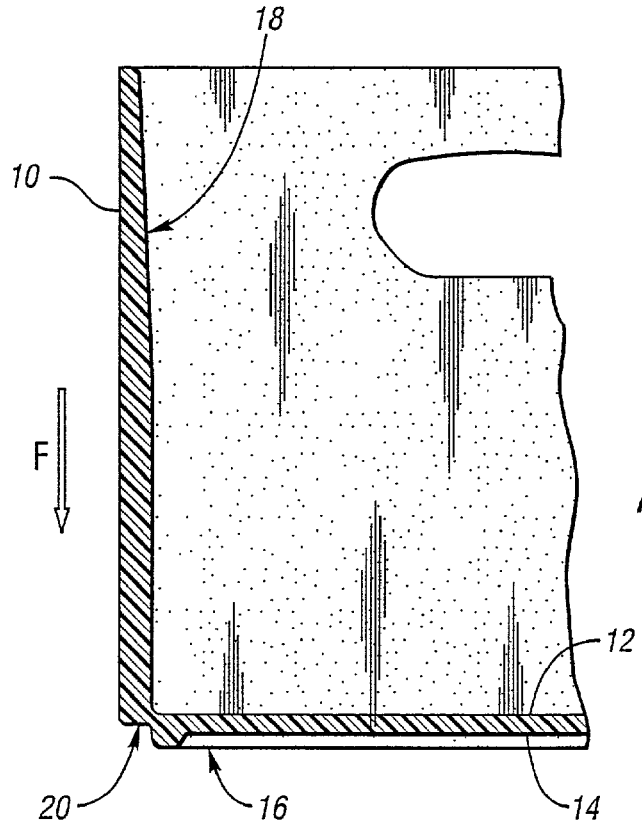
Fig. 1 (PRIOR ART)
FIG. 1 is a partial cross-section representation of a conventional crate.
Figure 5:
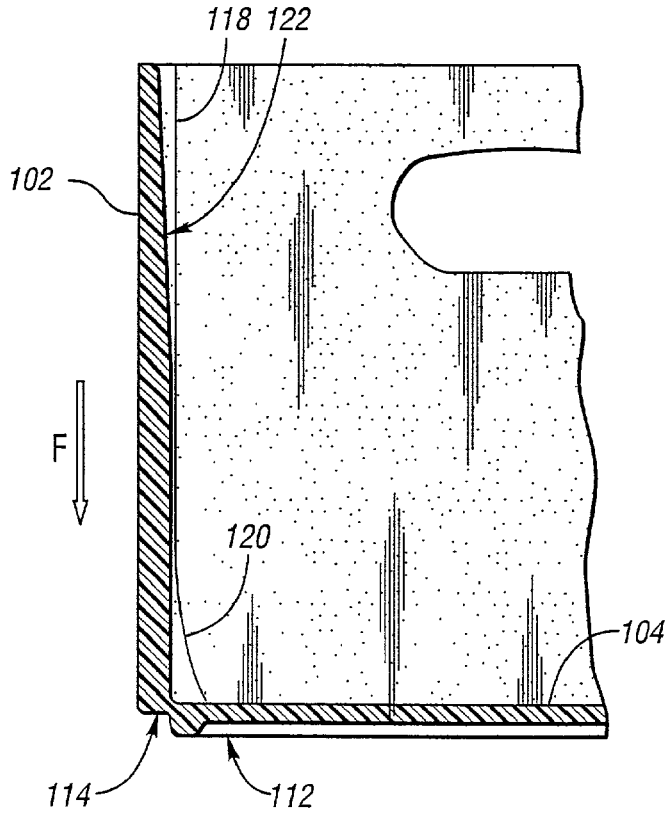
FIG. 5 is a partial cross-section representation of a crate in accordance with the present invention.

In accordance with another aspect of the present invention, a portion of the inner surface of each wall 102 is contoured so as to extend inwardly into vertical positioning over the drag rail 112. More specifically, as shown in FIG. 5, a portion of each side wall 102 is molded with a variable radius blend 120 into the bottom surface 104. The amount or degree of varying radius is selected so that the affected portion of the side wall inner surface is positioned over the drag rail.

In the exemplary embodiment, the variable radius blend portion 120 is formed at each bottom corner of the crate. However, it will be understood that the variable radius blend portion could be located at other locations. For example, the portion with the variable blend 120 could be located somewhere at the bottom of middle section 108, or extend along the entire inner circumference of the crate. By extending over the drag rail 112, the variable radius blend portion 120 allows loading forces (designated as "F" in FIG. 5) to be directly transferred down to the drag rail. This improves overall strength and rigidity of the crate without adding material or reinforcement.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A crate for holding and transporting products comprising:

a side wall integrally formed with a bottom surface; and a drag rail protruding from an underside portion of the bottom surface, the drag rail including a drag surface that is the lowermost surface of the crate, wherein an inner surface of the side wall is formed to position at least a portion of the side wall over the drag rail.

2. The crate of claim 1, wherein the inner side wall surface is formed as a variable radius blend into the bottom surface sufficient to position a portion of the side wall over the drag rail.

3. The crate of claim 1 wherein the side wall is a first side wall and is joined to a second side wall to form a corner, and the inner side wall surface of the first side wall and the second side wall is contoured at a lower surface of the corner so as to form a contoured portion extending inwardly from the first side wall and the second side wall over the drag rail.

4. The crate of claim 1 wherein the inner side wall surface is formed at a lower edge area proximate each vertically extending end of the side wall with an inwardly extending taper.

5. The crate of claim 1 further comprising a plurality of side walls formed as an open-top box having four corners, wherein a lower portion of each pair of adjacent side walls at the corner is contoured to form a single contoured portion extending inwardly from each of the two adjacent side walls over the drag rail.

6. The crate of claim 1 wherein the side wall is integrally formed with the bottom surface so that at least a portion of an opening in the crate has a larger dimension than the bottom surface, and another portion of an inner surface of the side wall is formed to reduce the dimension of the crate opening in at least one selected area so as to provide a tighter fit with a drag rail of a crate stacked thereon.

7. The crate of claim 6 wherein the side wall is joined to another side wall to form a corner, and the at least one selected area comprises the corner.

8. The crate of claim 6 wherein the at least one selected area comprises an upper edge area of the side wall.

9. The crate of claim 6 further comprising a plurality of side walls formed as an open-top box having four corners, wherein the at least one selected area comprises an upper portion of each side wall at each corner.

10. The crate of claim 1 wherein the drag rail protrudes downward from the underside portion of the bottom surface inward of the outer edge of the crate, the side wall meeting the bottom surface at a lower corner of the crate, the side wall further including a contact surface on a lower edge of the side wall adjacent to and outward of the drag rail at the lower corner, the contact surface dimensioned so as to rest on a top surface of a side wall of an identical crate.

11. The crate of claim 10, wherein the inner side wall surface is formed as a variable radius blend into the bottom surface sufficient to position a portion of the side wall over the drag rail.

12. The crate of claim 1 wherein the drag rail extends at least substantially parallel to the side wall.

13. The crate of claim 1 wherein the drag rail extends along at least substantially the entire length of the side wall.

14. The crate of claim 13 wherein the drag rail extends at least substantially parallel to the side wall.

15. The crate of claim 1 wherein the drag rail includes a corner portion.

16. A stackable crate for holding and transporting products comprising:

a side wall integrally formed with a bottom surface, the side wall formed so that at least a portion of an opening in the crate at a first distance from the bottom surface has a larger dimension than the bottom surface; and a drag rail formed on an underside portion of the bottom surface and positioned inward of an outer peripheral support surface of the crate, the side wall formed so that a top surface of the side wall would contact the outer peripheral support surface of a like crate stacked thereon, wherein a first portion of an inner surface of the side wall at the first distance from the bottom surface is formed to reduce the dimension of the crate opening in at least one selected area relative to a second portion of the inner surface of the side wall at the first distance from the bottom surface so as to provide a tighter fit with a drag rail of the like crate stacked thereon.

17. The crate of claim 16 wherein the side wall is joined to another side wall to form a corner, and the at least one selected area comprises the corner.

18. The crate of claim 16 wherein the at least one selected area comprises an upper edge area of the side wall.

19. The crate of claim 16 further comprising a plurality of side walls formed as an open-top box having four corners, wherein the at least one selected area comprises an upper portion of each side wall at each corner.

20. The crate of claim 16 wherein the side wall tapers outwardly from a vertical plane as the side wall extends upwardly from the bottom surface to enlarge a top opening of the crate, and the at least one selected area comprises a portion of the inner surface of the side wall formed without taper.

21. The crate of claim 16 wherein the side wall tapers outwardly from a vertical plane as the side wall extends upwardly from the bottom surface to enlarge a top opening of the crate, and the at least one selected area comprises a portion of the inner surface of the side wall formed with reduced taper.

22. The stackable crate of claim 16 wherein an inner surface of the side wall angles outwardly as the side wall extends upwardly from the bottom surface to enlarge a top opening of the crate, and the at least one selected area comprises a portion of the inner surface of the side wall angled less outwardly.

23. The stackable crate of claim 22 wherein a thickness of the side wall decreases as the side wall extends upwardly from the bottom surface to enlarge a top opening of the crate, and the at least one selected area comprises a portion of the side wall where the thickness is reduced less.

24. The stackable crate of claim 22 wherein at least one portion of an upper edge of the side wall is vertically aligned with at least one portion of a lower edge of the side wall, such that the side wall would support a side wall of an identical crate stacked on top of the crate and such that side walls of identical, stacked crates would not nest one within the other.

25. The stackable crate of claim 24 wherein the side wall meets the bottom surface at a lower corner of the crate, the drag rail protruding downward from the underside of the bottom surface at the lower corner.

26. The stackable crate of claim 25 wherein an outer surface of the side wall is generally perpendicular to the bottom surface.

27. The stackable crate of claim 16 wherein the drag rail protrudes downwardly from the underside portion of the bottom surface and wherein the drag rail includes drag surface that is a lowermost surface of the crate.

28. The stackable crate of claim 16 wherein the crate includes an inner peripheral surface at the first distance from the bottom surface, and wherein the at least one selected area is formed on the inner peripheral surface such that the at least one area reduces the dimension of the crate opening relative to a portion of the inner peripheral surface adjacent the at least one area at the first distance from the bottom surface.

29. The stackable crate of claim 16 wherein the crate includes a generally rectangular inner peripheral surface at the first distance from the bottom surface, wherein at least a portion of the inner peripheral surface has a larger inner dimension than the bottom surface, and wherein the at least one area protrudes inwardly from the generally rectangular inner peripheral surface at the first distance from the bottom surface.

30. The stackable crate of claim 29 wherein the side wall is joined to another side wall to form a corner, the at least one selected area comprises the corner and wherein the at least one area protrudes inwardly from the corner.

31. First and second identical stacked crates for holding and transporting products each comprising:

a side wall integrally formed with a bottom surface, an inner surface of the side wall moving outwardly from a vertical plane as the side wall extends upwardly from the bottom surface to enlarge an opening of the crate at a first distance from the bottom surface, at least one selected area of the side wall at the first distance from the bottom surface comprising a first portion of the inner surface of the side wall formed to reduce the dimension of the crate opening at the at least one selected area relative to a second portion of the inner surface of the side wall at the first distance from the bottom surface;

a drag rail extending from an underside portion of the bottom surface, the drag rail positioned inward of an outer peripheral edge of the crate; and the first crate supported on a top surface of the side wall of the second crate with the drag rail of the first crate positioned inward of the side wall and the at least one selected area of the second crate so as to provide a tighter fit between the drag rail of the first crate and the at least one selected area of the second crate.

32. The first and second crates of claim 31 wherein the side wall of the first crate is positioned directly on top of and supported by the side wall of the second crate, and wherein the drag rail of the first crate is positioned adjacent the side wall of the second crate.

33. The first and second crates of claim 32 wherein at least a portion of the side wall of the first crate is positioned directly on top of both the side wall of the second crate and the drag rail of the first crate.

34. A stackable crate for holding and transporting products comprising:

a plurality of side walls generally perpendicular to and integrally formed with a bottom surface, an inner surface of each of the side walls moving outwardly from a vertical plane as the side wall extends upwardly from the bottom surface to enlarge an upper opening of the crate at a first distance from the bottom surface, at least one portion of an upper edge of each of the side walls being vertically aligned with at least one portion of a lower edge of the each of the side walls; and a drag rail formed on an underside portion of the bottom surface and positioned inward of an outer periphery of the lower edges of the plurality of side walls, wherein a first portion of the inner surface of at least one of the side walls is formed to reduce the dimension of the upper opening of the crate in at least one selected area at the first distance from the bottom surface relative to a second portion of the inner surface at the first distance from the bottom surface, so as to provide a tighter fit with a drag rail of an identical crate stacked thereon.

35. The stackable crate of claim 34 wherein a thickness of each of the side walls is reduced as the side wall extends upwardly from the bottom surface.

36. The stackable crate of claim 35 wherein the at least one selected area is formed reducing the thickness of the side wall less at the at least one selected area at the first distance from the bottom surface than at the second portion of the inner surface at the first distance from the bottom surface.

37. The stackable crate of claim 35 wherein the inner surface of each of the side walls is formed to position at least a portion of the side wall over the drag rail.

38. The stackable crate of claim 37, wherein the inner surface of the side wall is formed as a variable radius blend into the bottom surface sufficient to position a portion of the side wall over the drag rail.

* * * * *